US008152659B1

(12) United States Patent
Wadley

(10) Patent No.: US 8,152,659 B1
(45) Date of Patent: Apr. 10, 2012

(54) FOOTBALL HOLDER

(76) Inventor: James Edward Wadley, Stillwater, OK (US)

( * ) Notice: Subject to any disclaimer, the term of this patent is extended or adjusted under 35 U.S.C. 154(b) by 0 days.

(21) Appl. No.: 12/731,217

(22) Filed: Mar. 25, 2010

Related U.S. Application Data

(60) Provisional application No. 61/180,170, filed on May 21, 2009.

(51) Int. Cl.
*A63B 69/00* (2006.01)

(52) U.S. Cl. ..... 473/438; 473/450; 473/458

(58) Field of Classification Search ..... 473/422, 473/450, 458, 464, 438; 224/991, 217, 247, 224/259, 260, 248, 251; 206/315.9; D3/224, D3/221
See application file for complete search history.

(56) References Cited

U.S. PATENT DOCUMENTS

| | | | | | |
|---|---|---|---|---|---|
| 4,065,040 | A | * | 12/1977 | Steere | 224/248 |
| 4,433,803 | A | * | 2/1984 | Liberboim | 224/251 |
| D290,306 | S | * | 6/1987 | Pickens | D3/224 |
| 4,706,860 | A | * | 11/1987 | Leider | 224/247 |
| 4,798,319 | A | * | 1/1989 | James, Jr. | 224/251 |
| 4,852,782 | A | * | 8/1989 | Wu et al. | 473/299 |
| 4,946,165 | A | | 8/1990 | Rambacher | |
| 5,326,005 | A | * | 7/1994 | Fisher | 224/661 |
| 5,464,209 | A | | 11/1995 | Sang | |
| D366,143 | S | * | 1/1996 | Guzman | D3/221 |
| 5,553,855 | A | | 9/1996 | Balestrieri | |
| 5,730,287 | A | * | 3/1998 | Martin | 206/315.9 |
| 5,842,621 | A | * | 12/1998 | Gschwind | 224/682 |
| D464,836 | S | | 10/2002 | Barrera | |
| 2008/0029564 | A1 | * | 2/2008 | Wong et al. | 224/600 |

* cited by examiner

*Primary Examiner* — Mitra Aryanpour
(74) *Attorney, Agent, or Firm* — Molly D. McKay

(57) ABSTRACT

A football holder for holding extra footballs on the side or hips of the quarterback until the quarterback is ready to throw the extra footballs. A pair of holders attach to the quarterback with a waist strap and two leg straps. Each holder has two spring-loaded cupped ends that are biased toward each other for holding the football there between. A football is inserted in the holder by spreading apart the two cupped ends and inserting the ends of the football between the two cupped ends of the holder. The bottom cupped end has a notch cut out of it to facilitate removal of the football from the holder by applying a twisting motion to the football.

15 Claims, 3 Drawing Sheets

FOOTBALL HOLDER

CROSS-REFERENCE TO RELATED APPLICATIONS

The present application claims priority to U.S. Provisional Patent Application Ser. No. 61/180,170 for Football Holder filed on May 21, 2009.

BACKGROUND OF THE INVENTION

1. Field of the Invention

The present invention relates to a holder that straps onto a quarterback's waist and legs to hold extra footballs during football practice so that the quarterback has extra footballs to throw for each practice play.

2. Description of the Related Art

Currently during football practice, a quarterback will throw a football to one person for each play. This results in most of the players engaging in many plays where they do not get an opportunity to practice receiving or catching the football. It would be desirable if the quarterback could throw several footballs during each practice play so that more of the players had an opportunity to practice receiving or catching the football. Unfortunately, the quarterback does not have enough hands to hold more than one football at a time and still be able to throw the ball properly. What is needed is a football holder that allows the quarterback to throw a football unobstructed and then quickly grab additional footballs so that multiple footballs can be thrown to various receivers during each practice play.

The present invention addresses this need by providing a holder for holding extra footballs on the side or hips of the quarterback until the quarterback is ready to throw the extra footballs. The holder attaches to the quarterback with a belt and a couple of straps. A belt extends around the waist of the quarterback and through the top end of one or more of the holders so that each of the holders is located on a side of the quarterback's hips. If two holders are to be used, a first leg strap extends around the upper portion of the left leg of the quarterback and through a bottom end of one of the holders to secure the first holder to the side of the left leg of the quarterback. A second leg strap extends around the upper portion of the right leg of the quarterback and through a bottom end of the other one of the holders to secure the second holder to the side of the right leg of the quarterback.

Each holder holds the football until the quarterback pulls the football out of the holder by employing a twisting motion. Each holder has two spring-loaded cupped ends that are biased toward each other for holding the football there between. One cupped end of the holder is provided at the top end of the holder and one cupped end located at the bottom end of the holder. The cupped end located at the bottom end of the holder preferably has a notch cut out of it to facilitate removal of the football from the holder.

To insert the football into the holder, the two cupped ends of the holder are spread apart and the two ends of the football are inserted between the two cupped ends of the holder. To remove the football from the holder, the lower end of the football is pulled out of the bottom cupped end via the notch cut out of the bottom cupped end and this releases the football from the holder.

SUMMARY OF THE INVENTION

The present invention is a football holder for holding extra footballs on the side or hips of the quarterback until the quarterback is ready to throw the extra footballs. The holder attaches to the quarterback with a belt and a couple of straps. A belt extends around the waist of the quarterback and through the top end of one or more of the holders so that each of the holders is located on a side of the quarterback's hips. If two holders are to be used, a first leg strap extends around the upper portion of the left leg of the quarterback and through a bottom end of one of the holders to secure the first holder to the side of the left leg of the quarterback. A second leg strap extends around the upper portion of the right leg of the quarterback and through a bottom end of the other one of the holders to secure the second holder to the side of the right leg of the quarterback. Each holder holds the football until the quarterback pulls the football out of the holder by employing a twisting motion.

Each holder has two spring-loaded cupped ends that are biased toward each other for holding the football there between. One cupped end of the holder is provided at the top end of the holder and one cupped end located at the bottom end of the holder. The cupped end located at the bottom end of the holder preferably has a notch cut out of it to facilitate removal of the football from the holder.

To insert the football into the holder, the two cupped ends of the holder are spread apart and the two ends of the football are inserted between the two cupped ends of the holder. To remove the football from the holder, the lower end of the football is pulled out of the bottom cupped end via the notch cut out of the bottom cupped end and this releases the football from the holder.

DETAILED DESCRIPTION OF THE PREFERRED EMBODIMENT

Figure 1:
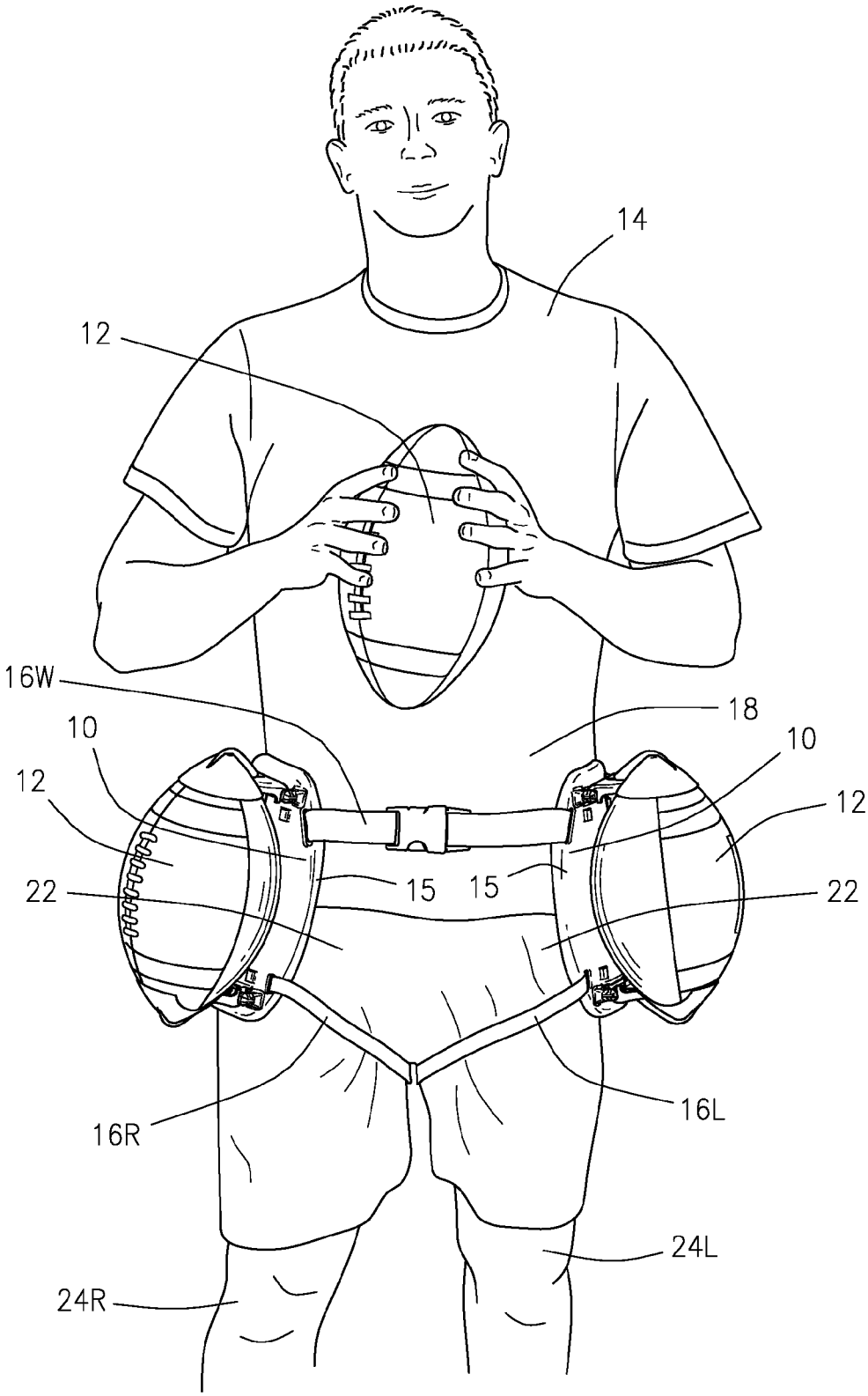
FIG. 1 is picture of a quarterback wearing two football holders constructed in accordance with a preferred embodiment of the present invention.
Figure 2:
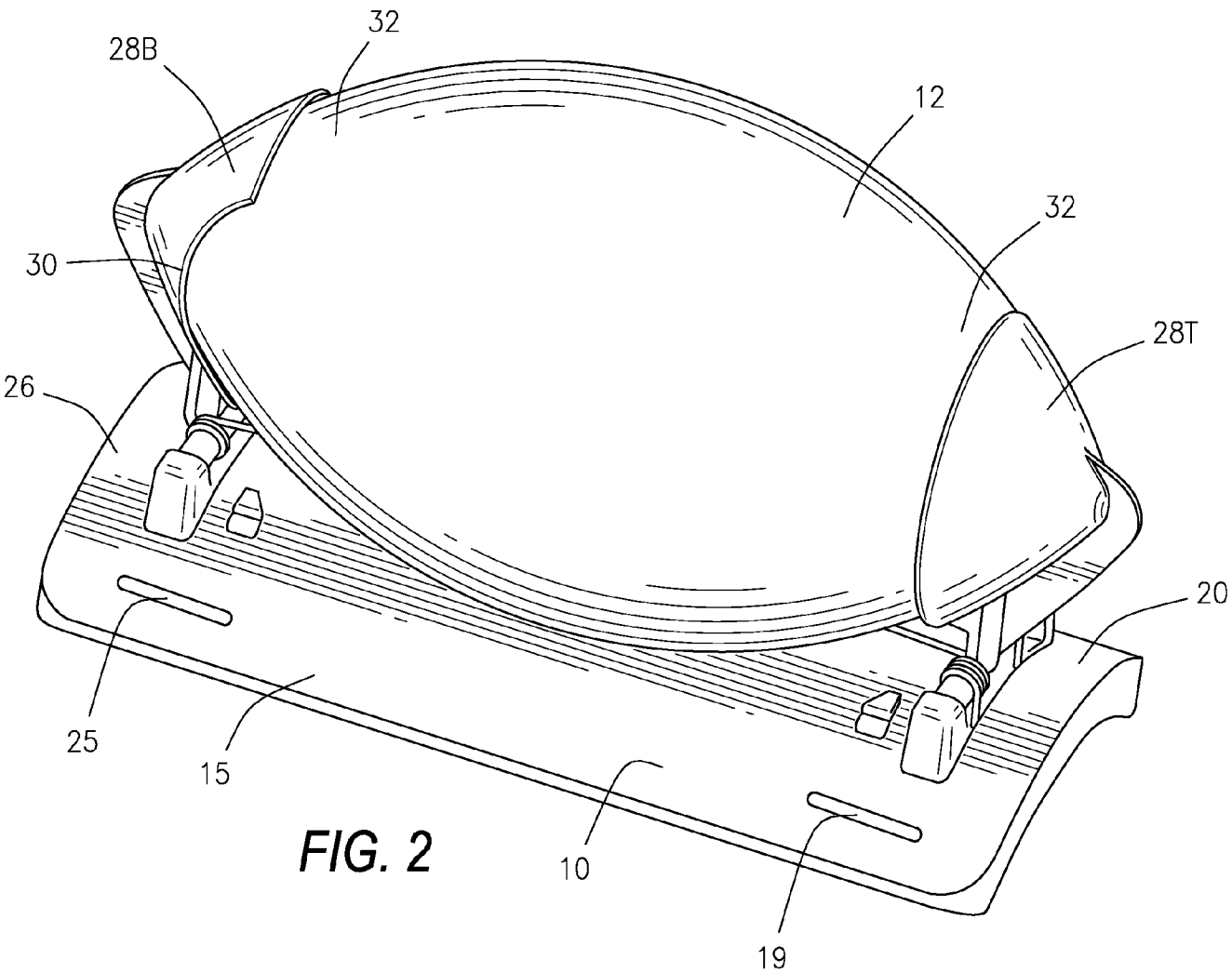
FIG. 2 is an enlarged perspective view of one of the football holders from FIG. 1, shown with a football attached.
Figure 3:
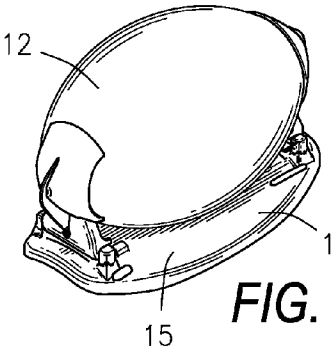
FIG. 3 is perspective view of the football holder of FIG. 2 shown from the front and bottom end with a football attached.
Figure 4:
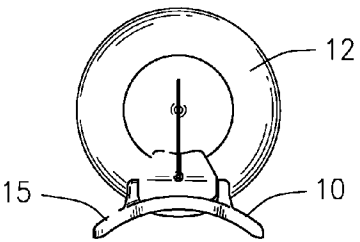
FIG. 4 is a top plan view of the holder of FIG. 3.
Figure 5:
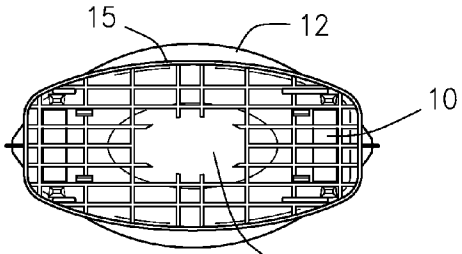
FIG. 5 is rear view of the holder of FIG. 3.
Figure 6:
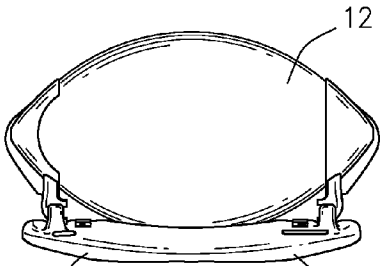
FIG. 6 is left side view of the holder of FIG. 3.
Figure 7:
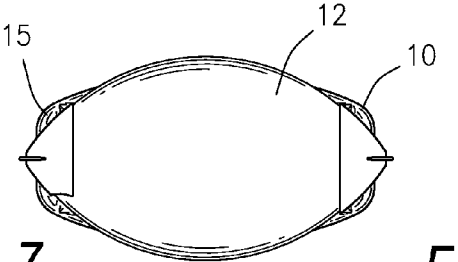
FIG. 7 is front plan view of the holder of FIG. 3.
Figure 8:
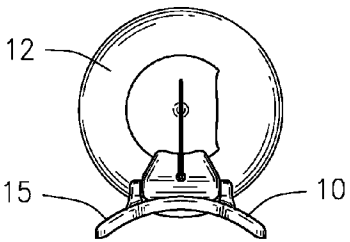
FIG. 8 is a bottom plan view of the holder of FIG. 3.
Figure 9:
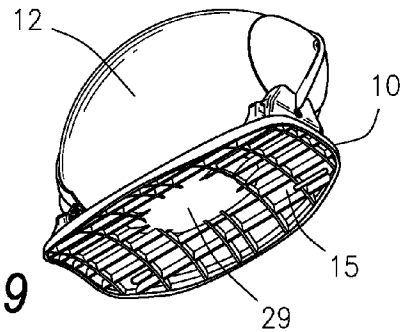
FIG. 9 is a perspective view of the holder of FIG. 3 shown from the rear and top end.

Referring now to the drawings and initially to FIGS. 1 and 2, the present invention is a football holder 10 for holding extra footballs 12 on the side or hips of a quarterback 14 until the quarterback 14 is ready to throw the extra footballs 12. A base portion 15 of the holder 10 attaches to the quarterback 14 with a belt 16W and a couple of leg straps 16L and 16R. The belt 16W extends around the waist 18 of the quarterback 12 and through belt openings 19 provided on either side in a top end 20 of one or more of the holders 10 so that each of the holders 10 is located on a one of the quarterback's hips 22. If two holders 10 are to be used, a first leg strap 16L extends around a left leg 24L of the quarterback 12 and through strap openings 25 provided on either side in a bottom end 26 of one of the holders 10 to secure the first holder 10 to the side of the left leg 24L of the quarterback 12. A second leg strap 16R extends around a right leg 24R of the quarterback 12 and through strap openings 25 provided on either side in the bottom end 26 of the second holder 10 to secure the second holder 10 to the side of the right leg 24R of the quarterback 12.

Referring also to FIGS. 3-9, each holder 10 holds the football 12 until the quarterback 12 pulls the football 12 out of the holder 10 by employing a twisting motion. Each holder 10 has two spring-loaded cupped ends 28T and 28B that attach to the base portion 15 and are located at the top end 20 and the bottom end 26 of the holder 10, respectively. The cupped ends 28T and 28B are biased toward each other for holding the football 12 there between. Also, the base portion 15 is provided with a central indented or cut out area 29 for receiving the curved side of football 12 in order to help secure the football 12 to the holder 10. The cupped end 28B located at the bottom end 26 of the holder 10 preferably has a notch 30 cut out of it to facilitate removal of the football 12 from the holder 10.

To insert the football 12 into the holder 10, the two cupped ends 28T and 28B of the holder 10 are spread apart and the two ends 32 of the football 12 are inserted between the two inwardly biased cupped ends 28T and 28B of the holder 10 which spring back together to grip the two ends 32 of the football 12, with the convex curved side of the football 12 seated in the indented area 29 of the base portion 15 to help hold the football 12 in place. To remove the football 12 from the holder 10, the lower end 32 of the football 12 is pulled out of the bottom cupped end 28B via the notch 30 using a twisting motion and this releases the football 12 from the holder 10.

The biased cupped ends 28T and 28B are designed so that they fold down into the cut out area 29 of the base portion 15 when the holder 10 is not in use, thereby allowing the holders 10 to be stored in a flat configuration, requiring a minimal amount of storage space and preventing damage to the cupped ends 28T and 28B.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A holder for an elongated football comprising:

two elongated football holding devices shaped to receive an elongated football, each of said two elongated football holding devices attached to a waist strap that is designed to secure around the waist of a user, each of said two elongated football holding devices attached to a separate leg strap, one leg strap designed to secure around a first leg of the user and a second leg strap designed to secure around a second leg of the user, and each of said two elongated football holding devices capable of holding an additional elongated football in a vertical orientation on one hip of a user until the user is ready to throw the additional elongated football;

wherein each of said two elongated football holding device includes a top cupped end for receiving a first pointed end of an elongated football and a bottom cupped end for receiving an opposite second pointed end of the same elongated football, the top and bottom cupped ends on each of said two elongated football holding device being spring loaded to bias the top and bottom cup ends toward each other for removably holding an elongated football there between; and wherein each bottom cupped end includes a notch to facilitate removal of an elongated football from the two elongated football holding device by applying a twisting motion to the elongated football.

2. The football holder for an elongated football according to claim 1 wherein the two elongated football holding devices are minor images of each other so that a first elongated football holding device fits onto the left side of the user and a second elongated football holding device fits onto the right side of the user when in use.

3. The holder for an elongated football according to claim 1 wherein each of said two elongated football holding devices further comprises:

a base portion, one of said top cupped ends and one of said bottom cupped ends movably attached to each base portion, said top and said bottom cupped ends on each base positioned in spaced apart orientation relative to each other, each said base portion attached to the waist strap and attached to one of said leg straps.

4. The holder for an elongated football according to claim 3 wherein each base portion further comprises:

a central indented area positioned in a front side of each base portion for receiving a curved side of an elongated football so that the central indented area cradles the curved side of the elongated football when the elongated football is held between the top and bottom cupped ends of the elongated football holding device.

5. The holder for an elongated football according to claim 4 further comprising:

each base portion includes a concave curved back side designed to fit around an outside curvature of a user's hip to which the elongated football holding device will be attached when in use.

6. The holder for an elongated football according to claim 5 further comprising:

each base portion includes a central opening therethrough of such a size and configuration that an elongated football held within each base portion by the top and bottom cupped ends extends through the central opening and beyond the back concave curved side of each base portion to rest against the hip of the user to allow the user to feel the elongated football against his hip.

7. A holder for an elongated football comprising:

at least one base portion, a plurality of straps engaging said at least one base portion for securing the at least one base portion to a hip of a user by extending around a waist and a leg of the user, a top cupped end for receiving a first pointed end of an elongated football movably secured to a top end of said at least one base portion, a bottom cupped end for receiving an opposite second pointed end of an elongated football movably secured to an opposite bottom end of said at least one base portion, said top cupped end and said bottom cupped end being spaced apart from each other on said at least one base portion and spring biased toward each other so that an elongated football can be held there between; and wherein the bottom cupped end includes a notch to facilitate removal of an elongated football from the holder by applying a twisting motion to the elongated football.

8. The holder for an elongated football according to claim 7 further comprising:

said at least one base includes two minor image bases for holding elongated footballs on a user left and right hip.

9. The holder for an elongated football according to claim 7 wherein the at least one base portion further comprises:

a central indented area positioned in a front side of each base for cradling a curved side of an elongated football when the elongated football is held between the top and bottom cupped ends of the at least one base.

10. The holder for an elongated football according to claim 7 wherein the at least one base portion further comprises:

a concave curved back side positioned on the at least one base portion designed to fit around an outside curvature of a user's hip to which the elongated football holding device attaches when in use.

11. The holder for an elongated football according to claim 7 further comprising:

the at least one base portion includes a central opening therethrough of such a size and configuration that an elongated football held within the base portion by the top and bottom cupped ends extends through the central opening and beyond the back concave curved side of the at least one base portion to rest against the hip of the user to allow the user to feel the elongated football against his hip.

12. The holder for an elongated football according to claim 7 wherein the at least one base portion further comprises:

a central indented area positioned in a front side of the at least one base for cradling a curved side of an elongated football when the elongated football is held between the top and bottom cupped ends of the at least one base.

13. The holder for an elongated football according to claim 12 wherein the at least one base portion further comprises:

a concave curved back side positioned on the at least one base portion designed to fit around an outside curvature of a user's hip to which the elongated football holding device attaches when in use.

14. The holder for an elongated football according to claim 13 further comprising:

the at least one base portion includes a central opening therethrough of such a size and configuration that an elongated football held within the at least one base portion by the top and bottom cupped ends extends through the central opening and beyond the back concave curved side of the at least one base portion to rest against the hip of the user to allow the user to feel the elongated football against his hip.

15. The holder for an elongated football according to claim 14 further comprising:

said at least one base includes two mirror image bases for holding elongated footballs on left and right hips of a user.

* * * * *